US006651797B1

(12) United States Patent
Tree

(10) Patent No.: US 6,651,797 B1
(45) Date of Patent: Nov. 25, 2003

(54) IN-WALL COIN BANK WITH NOVELTY FACE

(76) Inventor: Evan Tree, 11877 S. Hidden Canyon La., Sandy, UT (US) 84092

( * ) Notice: Subject to any disclaimer, the term of this patent is extended or adjusted under 35 U.S.C. 154(b) by 0 days.

(21) Appl. No.: 09/506,823

(22) Filed: Feb. 18, 2000

(51) Int. Cl.[7] ..... G07F 9/10

(52) U.S. Cl. ..... 194/352; 194/344; 194/350; 194/215; 235/379; 221/2; 221/3; 221/24; 222/23; 222/39; 222/78; 446/8; 446/10; 446/168

(58) Field of Search ..... 194/350; 221/24, 221/2, 3; 222/23, 39, 78; 40/721, 722, 465, 568, 463; 109/50–52; 235/379; 902/41; 446/8, 10, 118, 168, 169, 170, 173

(56) References Cited

U.S. PATENT DOCUMENTS 503,942 A * 8/1893 Buchanan ..... 273/138.3
508,019 A * 11/1893 Hunter ..... 194/350
508,922 A * 11/1893 Davis ..... 194/295
641,861 A * 1/1900 Huestis ..... 273/138.3
1,805,759 A 5/1931 Chamberlain
1,869,302 A 7/1932 Brosnan
2,010,877 A 8/1935 Morell
2,410,475 A 11/1946 Anderson
2,427,763 A 9/1947 Carper
2,508,146 A * 5/1950 D'Elia ..... 194/344
2,771,707 A * 11/1956 Ginsberg ..... 446/8
3,375,912 A * 4/1968 Weitzman ..... 194/346
3,783,986 A * 1/1974 Bolen ..... 194/350
3,825,265 A * 7/1974 Pitkanen et al. ..... 273/126 R
4,186,977 A 2/1980 Gilvoich et al.
4,278,033 A * 7/1981 Sobel ..... 109/59 R
4,324,059 A * 4/1982 Baum ..... 40/416
4,454,670 A * 6/1984 Bachmann et al. ..... 194/350
4,502,584 A * 3/1985 Lambiris ..... 194/257
4,510,381 A * 4/1985 Fukatsu ..... 109/24.1
4,579,213 A * 4/1986 Rhine et al. ..... 186/56
4,655,145 A 4/1987 Naylor
4,679,684 A * 7/1987 Glaser ..... 194/350
4,762,512 A * 8/1988 Divnick ..... 446/8
4,800,823 A * 1/1989 Hyatt ..... 109/24
4,871,055 A * 10/1989 Poythress et al. ..... 194/344
4,919,250 A * 4/1990 Olson et al. ..... 194/248
4,966,304 A * 10/1990 Kelly ..... 194/350
4,973,109 A * 11/1990 Diedrich ..... 194/350
4,976,376 A * 12/1990 Williams ..... 194/229
4,998,612 A * 3/1991 Halsey et al. ..... 16/264
5,029,863 A * 7/1991 Krawczyk et al. ..... 273/125 R
5,056,342 A * 10/1991 Prinz ..... 109/51
5,090,589 A * 2/1992 Brandes et al. ..... 221/2
5,090,699 A * 2/1992 Friedman ..... 273/118 R
5,114,772 A * 5/1992 Vives et al. ..... 109/80
5,133,441 A * 7/1992 Brown ..... 194/211
5,176,238 A * 1/1993 Deglau ..... 194/338
5,204,658 A * 4/1993 Beauquey ..... 341/22
5,220,631 A * 6/1993 Grippin ..... 385/115
5,282,765 A * 2/1994 Suzuki ..... 446/8
5,288,233 A * 2/1994 Green ..... 434/238
5,301,942 A * 4/1994 Lacrosse ..... 273/138.3
5,358,248 A * 10/1994 Jankosky ..... 273/153 J
5,360,134 A * 11/1994 Falk et al. ..... 221/12
5,363,984 A * 11/1994 Laird, III ..... 221/24
5,383,297 A * 1/1995 Summerville et al. ... 312/234.2

(List continued on next page.)

*Primary Examiner*—Donald P. Walsh
*Assistant Examiner*—Jeffrey A Shapiro
(74) *Attorney, Agent, or Firm*—Clayton, Howarth & Cannon, P.C.

(57) ABSTRACT

An in-wall coin bank with novelty face. The bank features a novelty face with an entertainment feature. The entertainment feature responds when a deposit is made, amusing or entertaining the user. The face may be detachable, different types of faces with entertainment features are possible. Methods of using the bank for saving are also disclosed and claimed.

3 Claims, 5 Drawing Sheets

U.S. PATENT DOCUMENTS 5,385,225 A 1/1995 Chen et al.
5,472,074 A * 12/1995 Milcetic ..... 194/342
5,513,853 A * 5/1996 Crompton et al. ..... 221/210
5,607,102 A 3/1997 Walsh et al.
5,615,123 A * 3/1997 Davidson et al. ..... 493/458
5,732,852 A * 3/1998 Baker et al. ..... 221/112
5,732,878 A 3/1998 Schroder et al.
5,782,378 A * 7/1998 Hart et al. ..... 221/155
5,877,969 A * 3/1999 Gerber ..... 116/33
5,887,696 A * 3/1999 Goetz ..... 194/208
5,888,115 A * 3/1999 Shoemaker et al. ..... 446/168
5,890,439 A 4/1999 McGunn
5,901,589 A * 5/1999 Cordero ..... 109/59 R
5,905,246 A * 5/1999 Fajkowski ..... 235/375
5,911,299 A * 6/1999 Aspnes et al. ..... 194/344
5,975,275 A * 11/1999 Keith et al. ..... 194/217
6,056,620 A * 5/2000 Tobin ..... 446/168
6,116,977 A * 9/2000 Tanny et al. ..... 446/8
6,135,261 A * 10/2000 Noell, Jr. et al. ..... 194/350
6,138,814 A * 10/2000 Miller et al. ..... 194/350
6,155,453 A * 12/2000 Coleman et al. ..... 221/225
6,196,371 B1 * 3/2001 Martin et al. ..... 194/317
6,227,970 B1 * 5/2001 Shimizu et al. ..... 273/138.1
6,267,663 B1 * 7/2001 Nottingham et al. ..... 194/344
6,283,268 B1 * 9/2001 Fletcher et al. ..... 194/344
6,298,973 B1 * 10/2001 Meade et al. ..... 194/318
6,386,538 B1 * 5/2002 Mejia ..... 273/118 R
6,505,774 B1 * 1/2003 Fulcher et al. ..... 235/381

* cited by examiner

IN-WALL COIN BANK WITH NOVELTY FACE

BACKGROUND OF THE INVENTION

1. The Field of the Invention

The present invention relates generally to devices for securely storing items of interest, and more particularly, but not entirely, to security devices for storing coins in an amusing or entertaining way.

2. Description of Related Art

It is common practice to store money or other items of interest in a secured fashion. It is well known to achieve this security by means of a safe, or a strongbox, which is attached to, or incorporated within another structure, such as a building wall, a post, or a freestanding masonry column. Examples of this type of construction can be found in U.S. Pat. No. 2,410,475 (granted Nov. 5, 1946 to Anderson), in U.S. Pat. No. 2,427,763 (granted Sep. 23, 1947 to Carper), in U.S. Pat. No. 1,805,759 (granted May 10, 1931 to Chamberlain), U.S. Pat. No. 1,869,302 (granted Jul. 26, 1932 to Brosnan), and U.S. Pat. No. 4,655,145 (granted Apr. 7, 1987 to Naylor)

It is noteworthy that none of the prior art known to applicant provides for an entertainment aspect in connection with a security storage device. All of the said prior art merely discloses safety boxes designed to secure and protect the items held inside, in various structurally unique ways but without evoking any amusement in particular. The exterior of the prior art devices is strictly functional. Applicant knows of no attempts to include an entertainment or amusement structure on the exterior of a security storage device.

The prior art thus has several inherent disadvantages. A secured storage device which includes only security features, is less appealing to consumers, as these are expensive specialty items which function only to securely store items. Further, such safes are often bulky, and take up a large volume compared to the storage space inside the safe. An in-wall safe takes up less space and can be hidden by a wall hanging. As a result consumers are less likely to purchase a freestanding storage device rather than lose home storage space, or take on the expense of an in-wall safe, often placing only the most economically valuable items in a safe deposit box.

There is thus a need for a secured storage device for household use, which preferably does not take up a large volume of space, can either be displayed or hidden, and which is useful for an entertainment purpose as well.

The present invention fulfills these needs by utilizing the methods and structural features described herein.

BRIEF SUMMARY AND OBJECTS OF THE INVENTION

It is therefore an object of the present invention to provide a means to securely store items of interest suitable for household use.

It is another object of the present invention, in accordance with one aspect thereof to provide a means to securely store items of interest and which does not take up a substantial amount of household storage space.

It is also an object of the present invention, in accordance with one aspect thereof, to provide a means for securely storing items of interest, which features an entertainment aspect.

It is a further object of the present invention, in accordance with one aspect thereof, to provide a means for securely storing items of interest, while allowing those items to be viewed.

It is an additional object of the invention, in accordance with one aspect thereof, to provide a means for securely storing items of interest, such as coins, with an entertainment feature that encourages users to save those items.

The above objects and others not specifically recited are realized in specific illustrative embodiments of the present invention.

One such embodiment comprises a device for securely storing items of interest, which has a novelty face. A means for evoking a response of entertainment, or amusement, from the user is disposed on the novelty face. The device can be installed in a wall, allowing items of interest to be securely stored and the means for evoking a response of amusement to be accessible. This in-wall design allows the device to be used in households to securely hold items of interest while conserving storage space, and the entertainment feature encourages users to collect the items of interest. The invention also includes methods of using the device for storing items of interest in a secured manner.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE INVENTION

Figure 1:
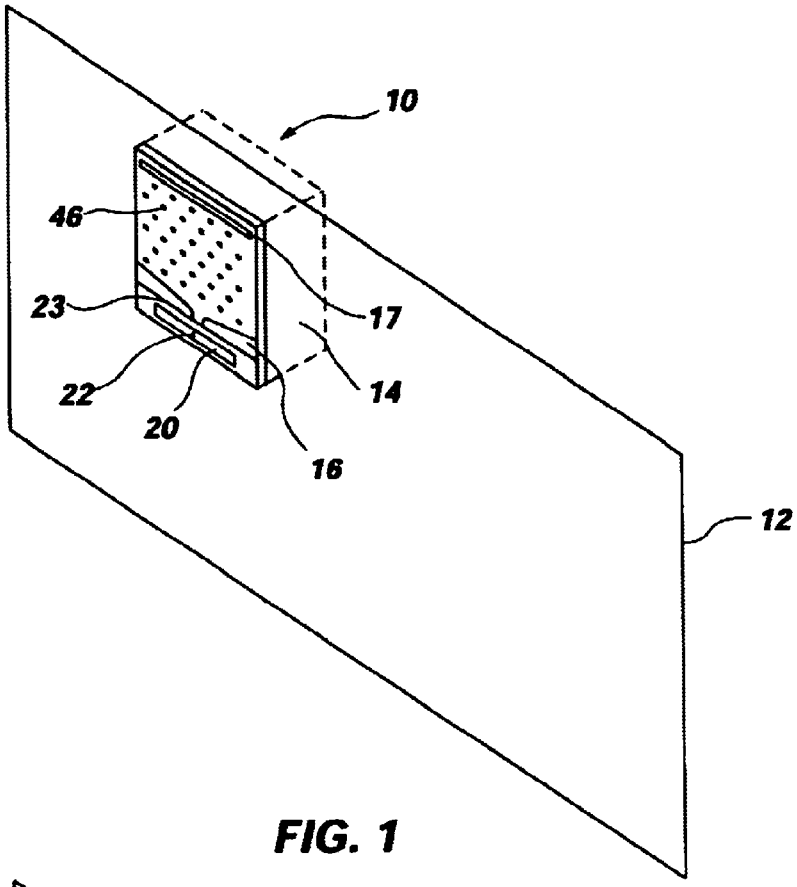
FIG. 1 is a perspective view of a first embodiment of an in-wall coin bank, shown installed in a building wall, made in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Applicant's invention is a unique device and method for the secured storage of items of interest, such as coins. The present invention combines the ability to securely store items of interest with an entertainment, or amusement, feature resulting in a product preferable for household use. Installing the device in a wall of a home or building reduces the displacement of space. The entertainment feature allows the device to remain in open view, or even be displayed. This design includes the key components of a security box and in addition a novelty face that features an evoking means for evoking a response of amusement or entertainment from the user.

Figure 1A:
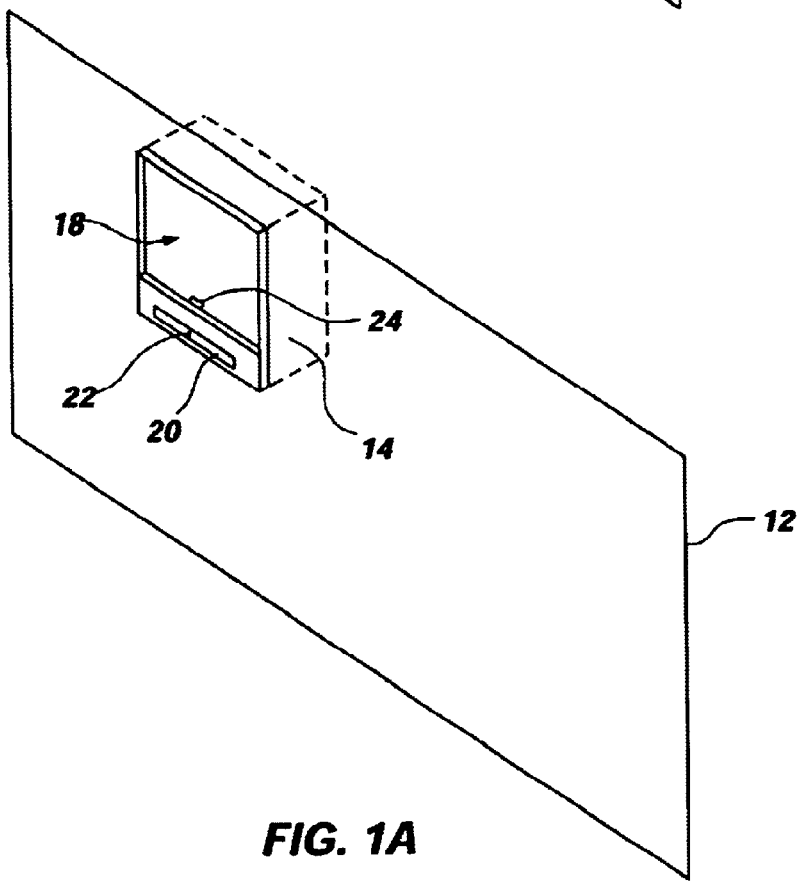
FIG. 1A is a perspective view of the embodiment also shown in FIG. 1, with the detachable face of the embodiment removed.

Referring to FIGS. 1 and 1A, there is shown a perspective view of a secured storage device in accordance with the present invention. It will be appreciated that many other embodiments are possible that are also in accordance with the present invention. The secured storage device with entertainment features, features a storage receptacle generally represented at 10, preferably installed in a building wall 12. The wall 12 may be a wall in a house or other building.

The storage receptacle 10, shown in FIGS. 1 and 1A, has two key components: a secure storage container 14, and a detachable face 16. The face 16 is designed to include a means for evoking a response of entertainment or amusement from the user and may be replaced with other interchangeable faces. Several possible embodiments of the face are later discussed, but the face features a means for receiving an item of interest, represented in this embodiment as coin slot 17 . In the embodiment of FIGS. 1 and 1A, the face 16 is constructed so as to be detachable from the secure storage container 14, and any means suitable for releasably attaching the face 16 to the secure storage container 14 may be used. It will be appreciated that embodiments wherein the face is nondetachable are also within the scope of the present invention. The secure storage container 14, is constructed to releasably receive the items of interest, such that means are provided for receiving the items, and means are provided for selectively preventing the removal of the items.

In the embodiment shown in FIGS. 1 and 1A, the means for receiving the items is a coin entrance, represented at 24, and the means for selectively preventing removal of items is the drawer 20, which has a locking mechanism, not explicitly shown, but represented by the keyhole, 22. Any means suitable for locking the secure storage container 14 may be used. When a user places an item of interest, in this case a coin, into coin slot 17, a means to evoke a response of entertainment, or amusement, is activated, and the coin then moves through the face 16 into the secure storage container 14 through coin entrance 24. In FIG. 1, the coin would fall under force of gravity into contact with bumper posts 46, eventually falling from face entrance 23 through internal coin entrance 24. When the user wants to retrieve the items, drawer 20 is unlocked and extended, allowing the items to be removed.

As shown in FIG. 1A, when the face 16 is removed, the front surface, represented at 18, of the secure storage container 14 subsurface is exposed. This front surface 18 may be constructed so that it is substantially one color. This color may be made to be substantially the same color as wall 12,such that the removal of the face 16 is less noticeable, increasing the security of the storage.

Figure 2:
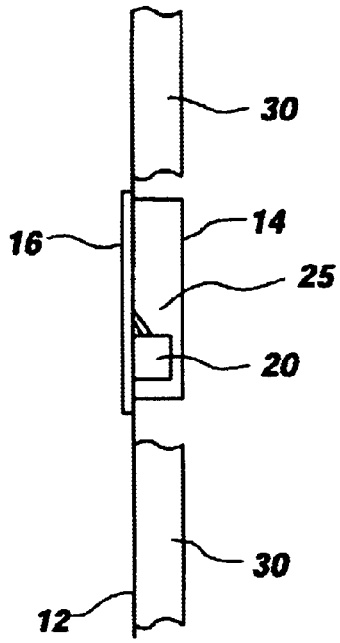
FIG. 2 is a side view of the in-wall coin bank of FIG. 1.

FIG. 2 shows a side view of the embodiment of FIGS. 1 and 1A. As FIG. 2 illustrates, the secured storage device with entertainment features 10 is securely installed in wall 12. The installation in FIG. 2 has been accomplished by fastening the secure storage container 14 to the framing of wall 12, secure storage container 14 is attached between stud 30 and an adjacent stud. Attachment may be done with any suitable means.

Figure 3A:
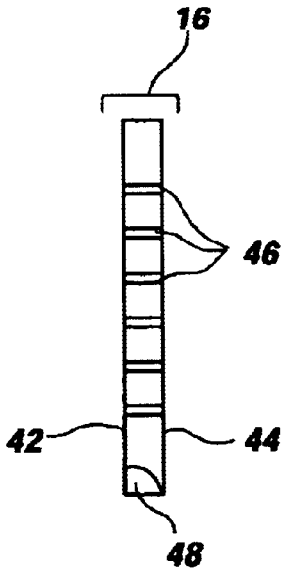
FIG. 3 and FIG. 3A are a front view and a side view of a detachable front with a transparent panel, which is a feature of the embodiment shown in FIGS. 1 and 1A.
Figure 3:
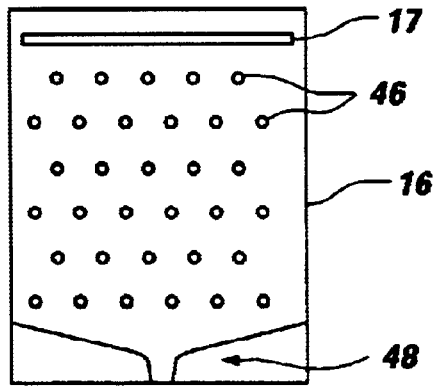

Reference will now be made to FIG. 3, which illustrates the detachable front face 16 of the embodiment of FIG. 1. As shown in FIG. 3, the front face 16 is detachable, allowing for alternative faces to be installed on the secure storage container 14. This allows a user to change the means for evoking a response of amusement of entertainment. Front face 16 features a means for receiving the item of interest, in the embodiment shown in FIG. 3 this is accomplished by a coin slot 17. Coin slot 17 allows a user to insert a coin along the most of the width of the face. Alternative embodiments of a means for receiving an item of interest include a coin slot which is moveable, a means for receiving printed currency and any other means known to those skilled in the art. When the user inserts a item, in this case a coin, into coin slot 17, it enters the space between the front panel, represented at 42, and the rear panel, represented at 44, in the embodiment shown in FIG. 3, front panel 42 is transparent, allowing the movement of the coin to be observed by the user.

The coin then falls by gravity down through the space between the front panel 42 and the rear panel 44. As it falls the coin encounters bumper posts 46. Bumper posts 46 force the item to move laterally to continue to fall, the movement of the coin as it falls serving as the means to evoke a response of amusement from the user. After moving past the posts 46, the item eventually falls into the coin receiver, represented at 48, and the item is funneled by the coin receiver 48 into the coin entrance 24, being received into the secure storage container 14.

It will be appreciated that other structures are capable of performing the function of evoking a response of amusement or entertainment. Alternative examples include bumper posts with differing shapes, bumpers, ramps or other structures which the coin interacts with while passing through the front face, as well as any other suitable structures known to those skilled in the art. Bumper posts or other structures may be arranged to cause entertaining movement of the coin, or other item deposited. Such arrangements include patterns, vertical alignment of bumper posts, bumper posts disposed in rows where every other row of bumper posts is vertically aligned.

Figure 7:
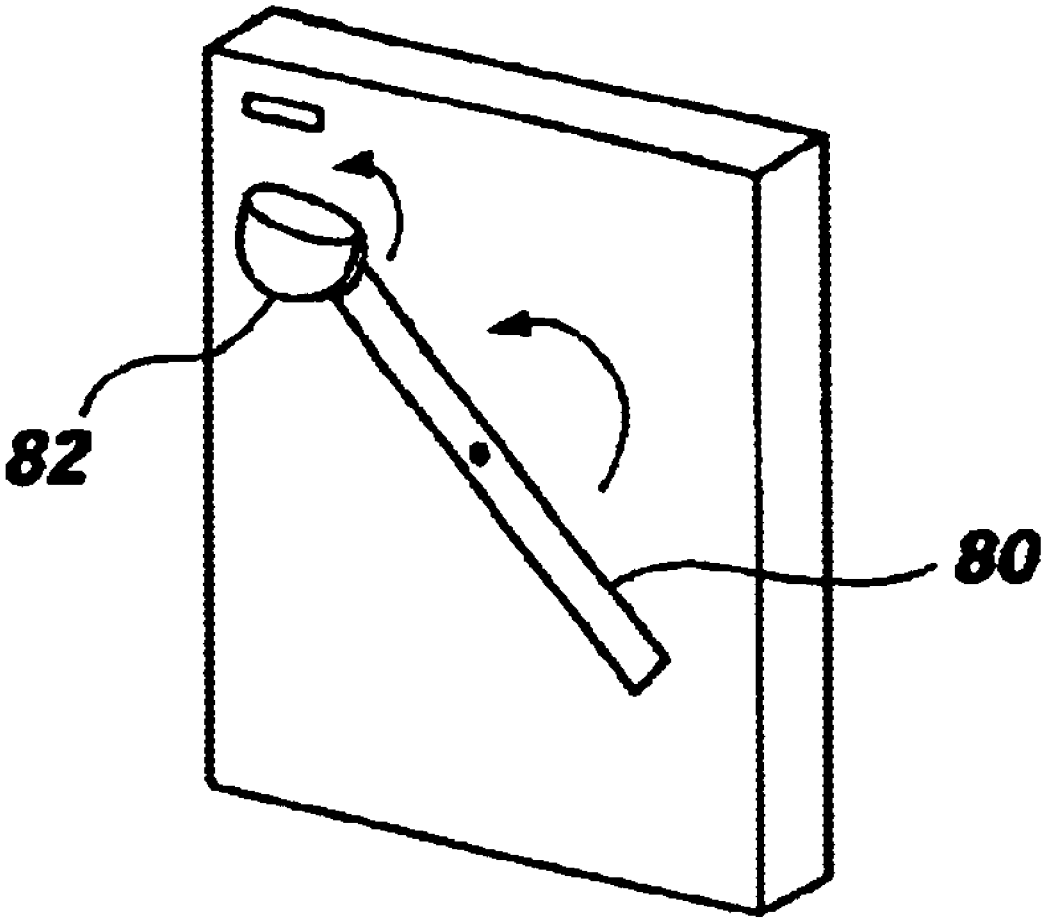
FIG. 7 is a schematic, alternative embodiment of the in-wall coin bank, with a mechanical pivot arm.

It will be further appreciated that the means for evoking a response of entertainment, or amusement, need not be accomplished by the use of gravity and fixed structures. Mechanical parts, such as throwing arms 80 (FIG. 7) and trapping fixtures among others known to those skilled in the art, which interact with the coin, or are activated by the insertion of the item, are included within the scope of the present invention. For example, the throwing arm 80 may pivot and include a pivotable cup 82. Any suitable movement piece or structure may be used.

In addition to the coin receiver 48 of FIG. 3, alternative structures which are capable of performing the same function may be used for releasably receiving the item into the secure storage container 14. An example of such an alternative structure is a coin receiver with multiple entry points for coins disposed throughout the space between the front panel 42 and back panel 44, which would be in lieu of the coin receiver 48 of FIG. 3. A point value can be assigned to each entry point, allowing for the deposit of coins to serve as a game. It will be appreciated that any structure known to those skilled in the art which will serve to collect and move the coins or other items into the secure storage container 14 will suffice and is included within the scope of the present invention.

The means for evoking a response of entertainment or amusement need not directly interact with the coin, or other item deposited. The deposit may instead trigger movement of movable mechanical parts viewable through the transparent panel. The means may also simply be an image disposed behind the transparent panel on a distinctive background panel, such as a picturesque scene, a depiction from a popular movie, a depiction of a popular animated character, or a multicolored panel.

The present invention also includes a method of using a device in the manner of, or similar to, the embodiments shown in FIG. 1 and FIG. 3. This method requires the construction of a secure storage receptacle with a frontal face, the frontal face having at least one transparent panel which allows the inner workings of the receptacle to be visible, the receptacle being installed in a wall, and the placing of items of interest into the receptacle, then observing the working of the inner receptacle workings which occur in response to the placement of the items.

An embodiment of this method is possible utilizing the device embodied in FIGS. 1 through 3. The secure storage receptacle 10, is constructed in a building wall 12, and it includes a front face 16 with at least one transparent front panel 42. When a user deposits a coin into the coin slot 17, the coin moves through the inner workings of the receptacle front face, and enters the secure storage container 14, through the coin receiver 48 and coin entrance 24. The coin is then releasably secured in the secured storage container 14 of FIGS. 1 through 3, from which the user can selectively remove it by means of a key or other suitable unlocking device. The present invention also includes a method of using the device for storage in this fashion, and of revealing the inner workings of the secured storage receptacle, by selecting a secured storage receptacle for in-wall installation rather than constructing one.

Figure 4:
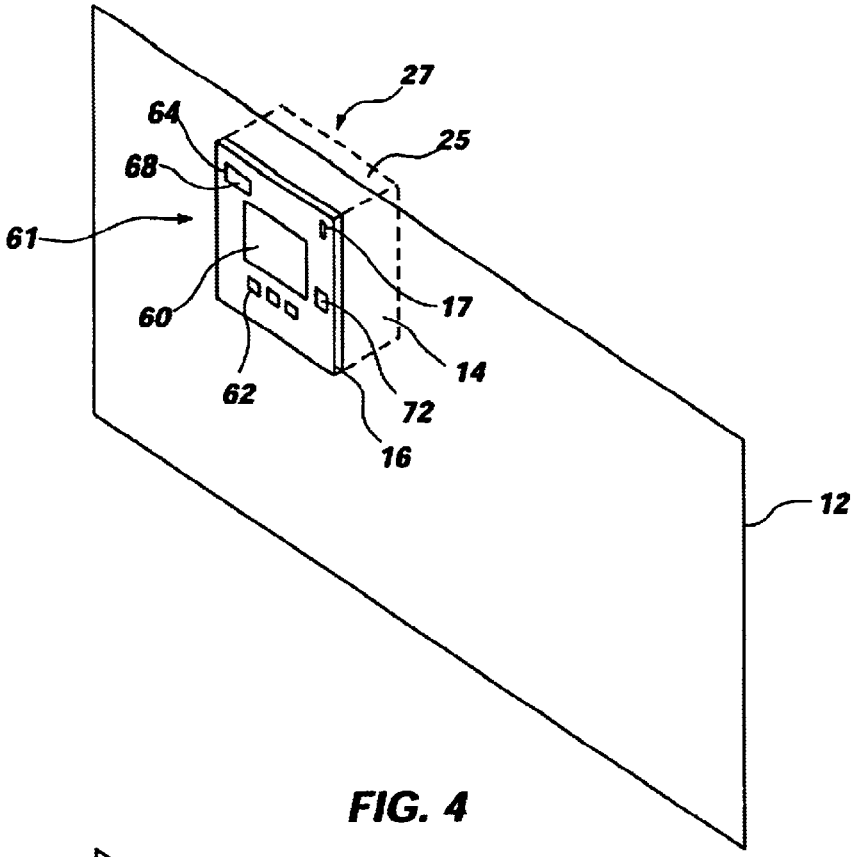
FIG. 4 is a perspective view of a second embodiment of the present invention, shown installed in a building wall.
Figure 4A:
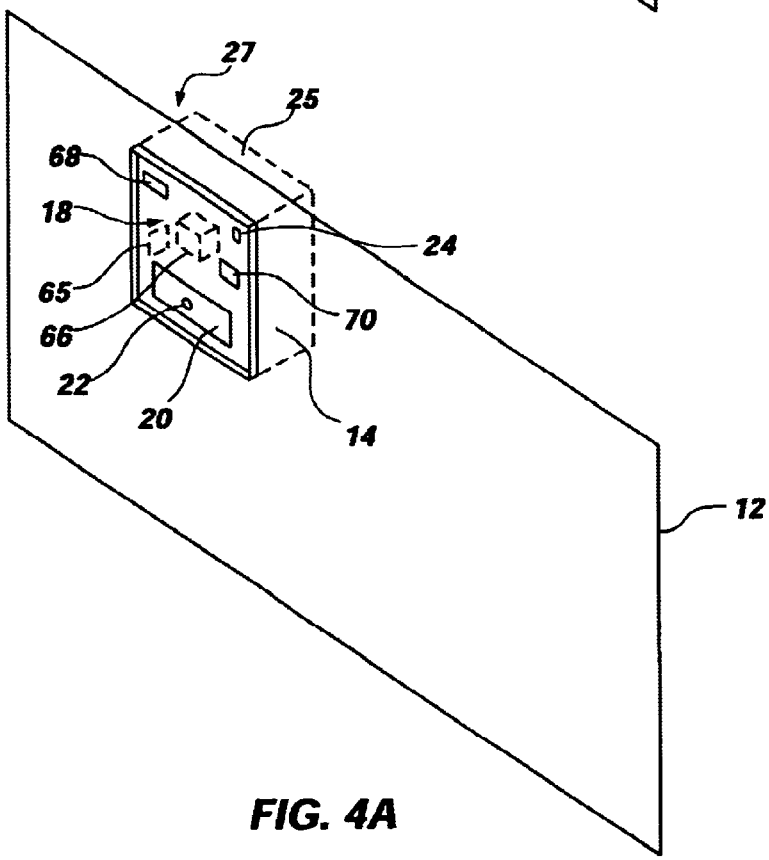
FIG. 4A is a perspective view of the embodiment also shown in FIG. 4, with the detachable face of the embodiment removed.

Reference will next be made to FIGS. 4 and 4A, which depict a perspective view of a second embodiment of a device in accordance with the present invention. This second embodiment of a storage receptacle 27 features a detachable front face 16 on which electronic means for evoking a response of entertainment, or amusement, generally represented at 61, are disposed. It will be appreciated that alternative embodiments of a secured storage device which feature electronic means for evoking a response of entertainment, or amusement, viewable on the front face of the device are included in the present invention. The device is preferably installed in a wall but may instead be freestanding, and may include a detachable or a nondetachable front face, or other arrangements which are readily known or ascertainable to those skilled in the art.

In the embodiment shown in FIG. 4 and 4A, the user inserts an item of interest, preferably a coin, into coin slot 17. This action then activates an amusement evoking electronic means 61 disposed on the front face 16. This may occur by the activating of a microswitch in response to coin movement, or through the closing of a circuit by the coin as a conductor, or by any other suitable means known to those skilled in the art. The coin enters a secure storage container 14, through coin entrance 24 (shown in FIG. 4A). The electronic amusement evoking means may be audible, it may be visible, it may require or allow interaction from the user in the form of a game, or it may be a combination of some or all of the foregoing. Structures representative of such types of responses are shown in FIGS. 4 and 4A, in the form of a screen, represented at 60, which is contained in the face 16, and may be an LCD, LED, active matrix flat monitor, or any other type of display known in the art, suitable for use; the buttons, represented at 62, which allow for user interaction with the electronic evoking means 61, or alternative user input structures may be used; a window represented at 64, and an associated display 68 which may be a display permanently mounted in the secure storage container 14, that is viewable through window 64 of the face 16 (the display 68 may be an LCD or LED device, or any other suitable display device known to those skilled in the art); a speaker, represented at 70, and a speaker vent, represented at 72, which allows the speaker 70 to be permanently mounted in the secure storage container 14 and emit sounds audible to the user through the speaker vent 72. A controller 65, and power supply 66, for the electronic evoking means are preferably a permanent part of the secure storage container 14, and preferably communicate with the detachable face 16 through suitable electronic contacts as known to those of ordinary skill in the art.

The container 14 is preferably permanently secured within wall 12, and includes the power supply elements and controller feature necessary to support the electronic workings of several interchangeable faces 16. A dead space 25 is useable to store any necessary circuitry, power supply 66, and the like.

The evoking means 61 for evoking a response of entertainment, or amusement from the user may be electronic as in the embodiment represented in FIG. 4, or it may instead constitute suitable mechanical movement. Alternatively, amusement may arise from the movement of the item of interest, as in the embodiment represented in FIG. 3, or it may be a combination of some or all of the foregoing, or it may be any other evoking means known or readily ascertainable to those skilled in the art. The presence of evoking means 61 encourages the user to save the items of interest. When the device 27 is installed in a wall, a user, such as a child, will be encouraged to save coins in the device and may other wise be entertained by the evoking means 61.

The present invention further includes a method of constructing, or selecting, a secure storage receptacle with a frontal face and a secured security means. The method includes the step of installing the secure storage receptacle in a building wall. The user then places an item of interest into the secure storage receptacle, and observes the electronic feedback, in response to the item of interest being releasably secured.

One such preferred method comprises the steps of:

(a) constructing a storage receptacle having a frontal face and further including security means for selectively preventing removal of contents of said receptacle;

(b) incorporating at least one transparent panel into a frontal face of the storage receptacle, in a position and arrangement such that inner workings of said storage receptacle are revealed by said transparent panel to an observer;

(c) recessing the storage receptacle within a wall of a building; and (d) placing one or more items of interest into the storage receptacle and observing inner workings of said receptacle that are caused in response to the placement of said one or more items of interest into said receptacle.

A further preferred method includes the steps of:

(a) constructing a storage receptacle having a frontal face and further including security means for selectively preventing removal of contents of said receptacle;

(b) incorporating electronic feedback means into a frontal face of the storage receptacle for providing electronically produced feedback to a user;

(c) recessing the storage receptacle within a wall of a building; and (d) placing one or more items of interest into the storage receptacle and interacting with electronically produced feedback that is caused in response to the placement of said one or more items of interest into said receptacle.

One embodiment of these methods is possible using the embodiment of a device shown in FIGS. 4 and 4A. The storage receptacle 27, is constructed and installed in building wall 12. A user places an item of interest (preferably a coin) into coin slot 17, this action activates electronic feedback, which is observed by the user. The feedback may be audible through speaker 70, visual through display 68 or screen 60, or a combination of audible and visual, it may also allow or require additional user input. The coin (not shown) enters the secured storage container 14 through coin entrance 24. It will be appreciated that other embodiments of this method are possible and may use any suitable alternate structures known to those skilled in the art.

Figure 5:
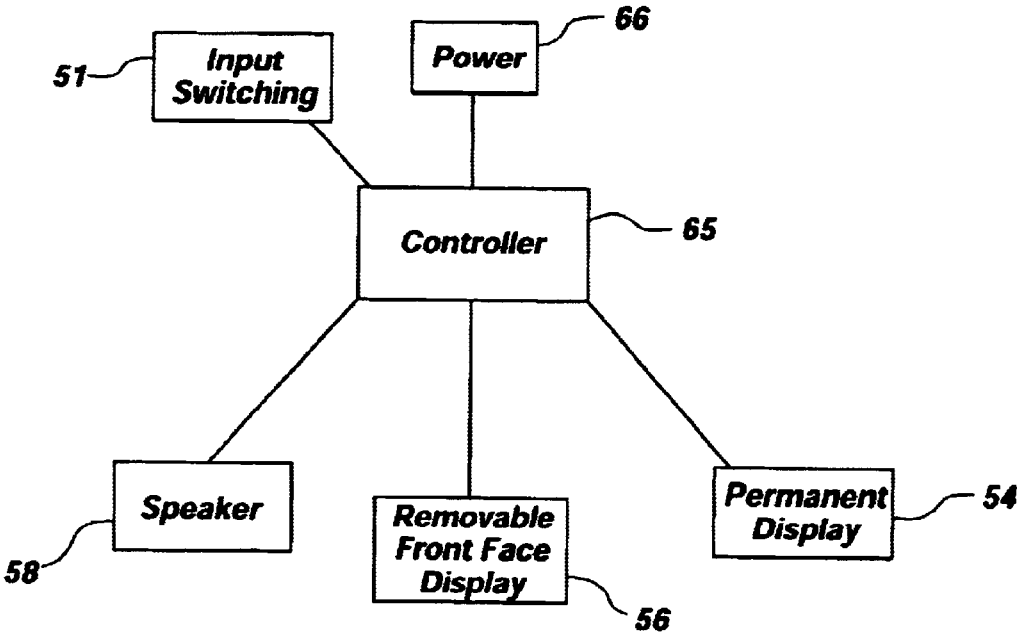
FIG. 5 is a schematic of a circuit useful for practicing one embodiment of the present invention.

In FIG. 5 is shown a schematic block diagram of control circuitry which may be used to operate the in-wall coin bank shown in FIGS. 4 and 4A. The components represented in FIG. 5 are readily understandable to those of skill in the art of conventional circuitry control operations. The power source mentioned above is illustrated as block 66. The power source 66 and input switching 51 are operatively connected to the controller 65, which is operatively connected to speaker 58, to removable front display 56, and to permanent display 54, as suggested above. Speaker 58 corresponds to speaker 70 of FIG. 4A, removable front display 56 corresponds to screen 60 of FIG. 4 and permanent display 54 corresponds to display 70 of FIG. 4A. Input switching block 51 may correspond to any input device, either a deposit initiated input or an input from a component such as button 62.

The block layout design of FIG. 5 illustrates the conventional nature of the hardware necessary to render the in-wall coin bank of FIGS. 4 and 4A operative. Those having ordinary skill in the art can program the controller 65 in various conventional ways to create an output through the speaker and displays that evoke a response of entertainment or amusement, upon the input of a coin, or even spontaneously without coin input. An example is the input of a coin being counted by the controller, which audibly or visually provides the value of the coin, or the total value of the deposit, or the total value of coins in stored in the bank 27. An alternative example is the use of the button inputs 62 to allow a user to play an electronic game. The operation sequence of the components illustrated in FIG. 5 necessary to achieve the performance characteristics described herein is readily ascertainable by those of ordinary skill without undue experimentation.

Figure 6:
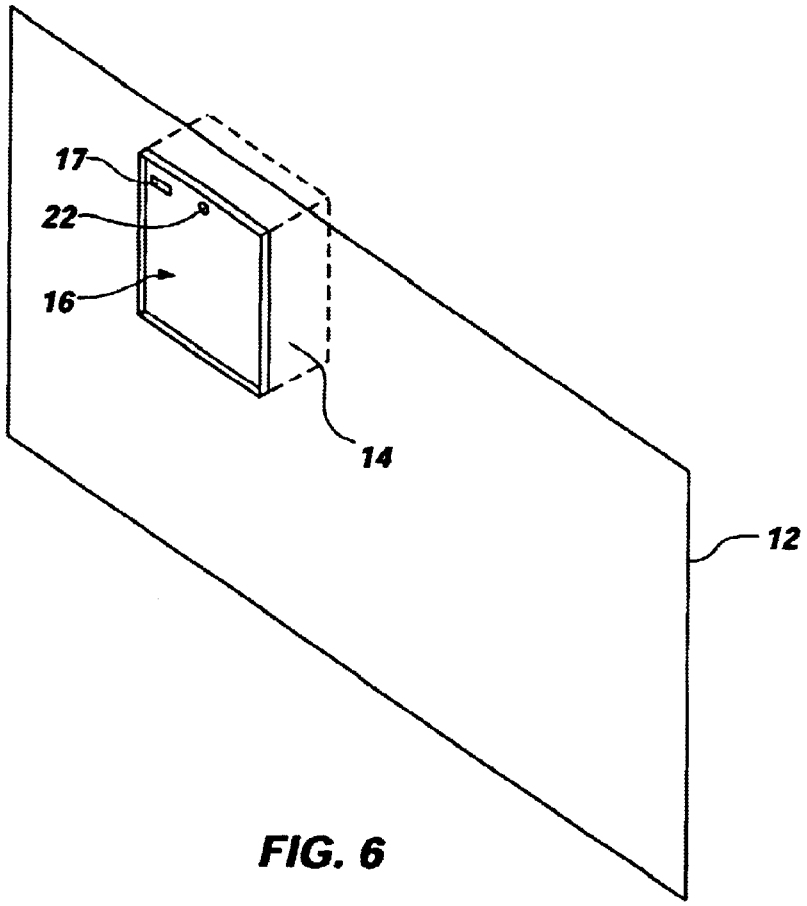
FIG. 6 is a perspective view of an alternative embodiment of the present invention, which features a transparent face.

Another embodiment of a device in accordance with the present invention is shown in FIG. 6. As represented in FIG. 6, this embodiment features a front face 16 which is transparent and also serves as the front surface of the secure storage container 14. The securing is done by any suitable locking mechanism, indicated here by the keyhole 22. In the FIG. 6 embodiment, the evoking of a response of entertainment, or amusement, is accomplished by the display of the items of interest within the secure storage container 14. For the embodiment shown in FIG. 6, the preferred items are coins, which are received into the secure storage container 14 through coin slot 17. The coins fill the secure storage container 14 and are visible through the transparent face 16. The displayed pile of coins may serve to encourage saving and otherwise evoke a response of amusement from the user, similar to the common practice of saving coins in a large bottle.

It will be appreciated that the embodiments discussed above demonstrate that present invention fulfills the objects of providing a means for securely storing items of interest; that is suitable for household use; includes an entertainment feature, which may allow the items of interest to be viewed while securely stored; and does not use a substantial amount of household storage space. It will be further appreciated that the entertainment feature encourages user's to save items of interest with the means of the present invention.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A coin bank for protecting and safekeeping coins, said coin bank comprising:

a slot for receiving said coins therethrough;

a container for releasably receiving the coins thereinto, said container including a coin entrance leading to said container, and security means for selectively preventing removal of said coins from said container;

a plurality of bumper posts positioned between said slot and said container, said plurality of bumper posts defining a plurality of travel paths for said coins;

a frontal face, said frontal face including a transparent panel for allowing movement of said coins to be observed by a user as the coins move along said travel paths;

electronic means for producing an observable output, wherein the electronic means further comprises an audible output means for producing an audible sound responsive to coin movement when at least one coin travels along one of the travel paths defined by the bumper posts, for evoking a response of entertainment, or amusement from the user;

wherein the plurality of bumper posts extend in a direction substantially perpendicular to said frontal face;

wherein the plurality of bumper posts are disposed in horizontal rows, wherein the bumper posts in said horizontal rows align vertically with bumper posts in every other row, and wherein the bumper posts in said horizontal rows are displaced from vertical alignment with bumper posts in adjacent horizontal rows;

wherein said transparent panel is planar and configured to extend parallel to a wall of a building;

wherein said coin bank further comprises a background panel arranged in a parallel orientation with respect to said transparent panel;

wherein said plurality of bumper posts reside between said transparent panel and said background panel such that said bumper posts extend from said background panel to said front panel to thereby reside sandwiched between said background panel and said front panel and wherein said bumper posts thereby extend in a perpendicular orientation with respect to said background panel and said front panel;

wherein the transparent panel, background panel, and bumper posts collectively comprise a means for causing a visible, manipulative movement of coins having diverted lateral coin movement combined with downward vertical coin movement such that when said coins are inserted into said slot, said coins fall into contact with at least some of said bumper posts causing the coins to visibly move both downwardly and laterally toward said container in a manner configured to evoke a reaction of interest or amusement;

wherein said coin bank further comprises a distinctive image disposed on the frontal face;

wherein the distinctive image is selected from the group consisting of: a picturesque scene; a depiction from a popular movie; a depiction of a popular animated character; and a multicolored panel;

wherein said coin bank further comprises calculating means for calculating the value of the coins received into the container;

wherein the calculating means further comprises means for calculating the total value of the coins deposited;

wherein said coin bank further comprises display means for displaying an amount calculated;

wherein said plurality of bumper posts each comprise a cylindrical configuration, and wherein said plurality of bumper posts are exposed to be contacted by said coins around an entire circumference of said bumper posts; and wherein said slot extends along a majority width of said coin bank such that said coins can be deposited at various locations along the width of said coin bank.

2. The coin bank of claim 1, wherein the calculating means further comprises means for calculating the value of a coin deposited.

3. The coin bank of claim 1, wherein said coin bank further comprises means for audibly outputting an amount calculated.

* * * * *